United States Patent [19]

Sawamoto

[11] 4,025,597

[45] May 24, 1977

[54] METHOD OF MAKING BRASSIERE CUP

[75] Inventor: Koshi Sawamoto, Neyagawa, Japan

[73] Assignee: Sawamoto Sangyo Kabushiki Kaisha, Japan

[22] Filed: Feb. 23, 1976

[21] Appl. No.: 660,362

[30] Foreign Application Priority Data

Mar. 14, 1975 Japan ..... 50-31650
Mar. 14, 1975 Japan ..... 50-31651

[52] U.S. Cl. ..... 264/138; 264/321; 264/322; 264/324; 264/327

[51] Int. Cl.[2] ..... B29D 27/00

[58] Field of Search ..... 264/322, 324, 327, 321, 264/292, 138

[56] References Cited

UNITED STATES PATENTS

| | | | |
|---|---|---|---|
| 2,190,807 | 2/1940 | Steinberger | 264/324 X |
| 2,378,642 | 6/1945 | Kopplin | 264/292 X |
| 2,963,744 | 12/1960 | Cooper | 264/292 |
| 3,164,655 | 1/1965 | Howard | 264/321 |
| 3,348,549 | 10/1967 | Brodmann | 264/324 X |
| 3,502,083 | 3/1970 | Howard | 264/324 X |
| 3,534,128 | 10/1970 | Makowski | 264/327 X |
| 3,597,800 | 8/1971 | Silverman | 264/292 X |
| 3,676,542 | 7/1972 | Maltby | 264/327 X |

*Primary Examiner*—Richard R. Kucia
*Attorney, Agent, or Firm*—Eugene E. Geoffrey, Jr.

[57] ABSTRACT

A brassiere cup of a resilient fibrous material intermixed with a resin formed by cooperating male and female die parts with the male die having a pad formed over the apex. The die parts are heated to a temprature above the softening temperature of the resin while said pad is maintained at a temperature below the softening temperature of the resin whereby the cup upon removal from the mold will have a thin peripheral portion and the material at the apex will expand to provide an apex of greater thickness.

5 Claims, 5 Drawing Figures

METHOD OF MAKING BRASSIERE CUP

This invention relates to an improved method of making brassiere cups. This method is especially useful in the manufacture of a brassiere cup from a soft fibre board material having a wall thickness which is substanially greater at the outer or apex portion than at the peripheral portion adjoining the base.

A brassiere cup is required generally to be light and soft and have high air permeability and sufficient thickness. Prior brassiere cups made of sponge material such as of polyurethane resin or the like almost meet this requirement but have the disadvantage is that it discolors and becomes yellow during use and gives a feeling of a physical disorder. This has resulted in the tendency to fabricate brassiere cups made of fibrous material. According to a prior art method, however, the fibrous brassiere cup is like a felt which is thin, hard and lacking in resiliency and it has been difficult to produce a thick, light, soft and resilient cup. Moreover, it is almost impossible to produce a fibrous brassiere cup having a wall thickness which is substanially greater at the apex portion than at the peripheral portion of the base.

Accordingly, an object of this invention is to provide an improved method of manufacturing a brassiere cup from a soft fibrous material, which can easily produce a brassiere cup having the variable thickness as described above, and without the addition of any special treatment step.

Known fibrous brassiere cups are press-formed from a soft fibre board material previously mixed with suitable thermo-plastic resin between male and female dies which are heated at least above the softening temperature of the thermoplastic resin and form a predetermined molding cavity therebetween.

According to a feature of this invention, a rounded projection or pad is provided at the apex portion of the male die so that the gap between said projection and the female die in the engaged condition becomes significantly less than the wall thickness of the product at the corresponding position, and the temperature of this projection is maintained substantially lower than the softening temperature of the above thermo-plastic resin.

According to another feature of this invention, a horizontal step portion having a contour which is substantially similar to but greater than the contour of the aperture of the female die is provided around this aperture and the soft fibre board material is cut in a shape of this contour of the horizontal step portion and fit in said portion, whereby the peripheral portion of the material is not pressed between the horizontal planes of the dies in the engaged condition.

Other objects and features of this invention will be described in more detail hereinunder with reference to the accompanying drawings.

In the drawings.

Throughout the drawings, like reference numerals are used to denote corresponding components.

Figure 1:
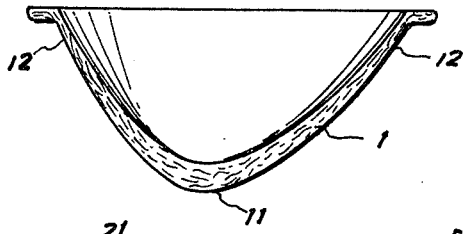
FIG. 1 is a cross sectional side view representing an example of fibrous brassiere cup made in accordance with this invention.
Figure 2:
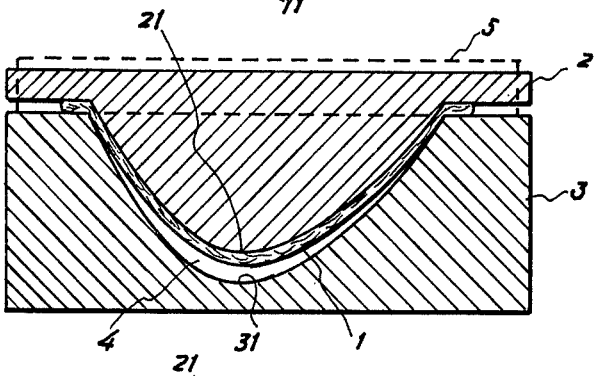
FIG. 2 (PRIOR ART)
FIG. 2 is a cross sectional side view representing one step of process according to a prior art method.

FIG. 1 shows a vertical sectional contour of typical brassiere cup 1 which is conveniently made in accordance with the method of this invention from a soft fibre board material. As shown, the brassiere cup 1 has a wall thickness which is greatest at the outer or apex portion 11 and least at the peripheral portion 12. According to a prior art method, the such brassiere cup 1 was made by hot press working of a flat fibre board 5 shown by dashed line in FIG. 2 and impregnated or intermixed with thermoplastic resin. Molding was accomplished by a set of heated stamping dies 2 and 3 having a mold cavity 4 having substantially the same geometry as the product, as shown in FIG. 2. The stamping dies were heated at a temperature higher than the softening temperature of the thermoplastic resin but much lower than that of the fibre board material and, therefore, the fibres filling the cavity 4 would be fixed in shape as it was with the fused thermoplastic resin when cooled.

In practice, however when the soft fibre board 5 is pressed by the male die 2, the fibre board 5 encounters the greatest horizontal tension and resultant high compression at the apex 21 of the male die 2 and reduces its thickness to leave a crevice at the bottom 31 of the female die 3 as shown in FIG. 2. Thus, a brassiere cup having variable wall thickness as shown in FIG. 1 could not be made satisfactorily in accordance with the prior art method.

Figure 3:
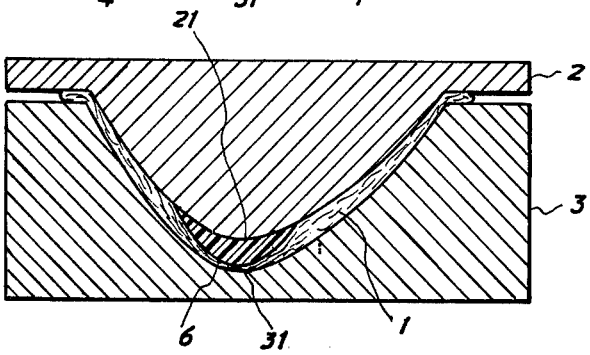
FIG. 3 is a cross sectional side view representing one step of process according to an embodiment of the method of this invention and corresponding to the step of FIG. 2.

FIG. 3 shows an embodiment of the stamping dies used in the same method of this invention. In this embodiment, the metallic dies 2 and 3 are somewhat similar to those of the prior art as shown in FIG. 2, but the male die 2 is provided with a central projection 6 at the apex 21. The projection 6 has a rounded shape with the outer surface approaching the bottom 31 of the female die 3 to reduce the mold cavity significantly. In this embodiment, the projection 6 is made of fluorine resin and adhered to the die 2 by refractory adhesive.

As an example, when the fibre board 5 is made of polyester fibres having a softening temperature above 200°C and impregnated with latex resin having a softening temperature of 130° to 140°C, the male die 2 is heated to about 185°C and the female die 3 is heated to about 150°C by conventional heating means such as electric heating elements or a heated fluid flowing through the dies. Under this condition, the surface temperature of the projection 6 made of fluorine resin is maintained at 100° to 120° C throughout the operation. Accordingly, the latex resin existing in the polyester fibre layer 1 which is pressed by the projection 6 is not heated up to its softening temperature, while that existing in the layer 1 which is pinched between the both die surfaces is heated up to is softening temperature and fused to fix the shape of the fibre layer in the compressed condition. When the product is discharged from the dies and cooled, therefore, the central portion 11 of the fibre layer 1 expands due to its resiliency, while the peripheral portion 12 maintains its molded shape. This results in a variable wall thickness of the brassiere cup as shown in FIG. 1.

While a flourine resin has been given as an example, any material having relatively low thermal conductivity can be used as the material of the projection 6. Wood and paper board are suitable for this purpose but have relatively short lifetimes due to carbonization. Also, the projection 6 can be made of thermally conductive material such as metal, which may be integral with the die 2, and cooled with a suitable coolant flowing therethrough.

Figure 4:
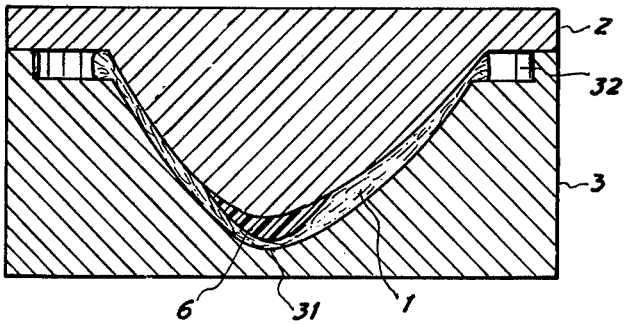
FIG. 4 is a cross sectional side view representing the similar step of process according to another embodiment of the method of this invention.
Figure 5:
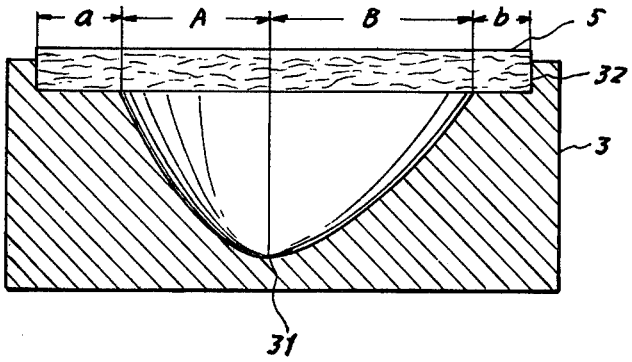
FIG. 5 is a cross sectional side view illustrating the dimensional relationships of the female die used in the embodiment of FIG. 4.

FIGS. 4 and 5 show another feature of this invention proposed to further improve the effect of the projection 6. In this embodiment, the female die 3 has a flat step portion 32 around the aperture edge. The contour of this step portion 32 is similar to the contour of the aperture edge and the depth of the step is little less than the thickness of the fibre board 5 to be used. The object of this step portion is to prevent the peripheral portion of the fibre board 5 from being pinched between the both dies 2 and 3 and block its free movement therebetween. This results in reduction of horizontal tension of the fibre layer 1 in the central portion 11 during the molding operations and consequently increases the expansion of the layer 1.

It has been found preferable to select the width of the step portion 32 so that it is substantially inversely proportional to the horizontal distance to the corresponding aperture edge from the bottom 31 of the female die 3. This relation is expressed as follows in accordance with FIG. 5.

$$A/B = b/a$$

The fibre board 5 is previously cut in a contour which is substantially same as the contour of the step portion 32 and fits therein as shown in FIG. 5.

As described above, in the brassiere cup made by the method of this invention, the fibre layer 1 does not encounter the thermal-setting effect of the thermoplastic resin at the central portion 11 and is very soft as compared with the prior cups. Thus, a brassiere cup which is light and soft, having high air permeability, and gives no feeling of physical disorder can be manufactured easily in accordance with this invention.

While the fibre material and the thermoplastic resin referred to above have the desired temperature characteristics any other similar materials having similar temperature characteristics can be used in this method. For example, fibre boards of polyamide, polyurethane, polyethylene, polypropylene and like synthetic resin fibres, natural cotton and like natural fibres and mixtures thereof, impregnated or intermixed with various thermoplastic resin adhesives can be used. Moreover, instead of impregnating the fibre board with adhesive resin, a fibre board intermixed with thermoplastic resin fibres may be used conveniently.

What is claimed is:

1. A method of making a brassiere cup having a wall thickness which is greater at the apex portion than at the peripheral portion, by press-shaping a soft fibre board intermixed with thermoplastic resin with a set of male and female dies which are heated to a temperature substantially higher than the softening temperature of said thermoplastic resin and forming a predetermined mold cavity when closed, a pad of rounded configuration overlying the apex portion of said male die, whereby the gap between the top of said projection and the female die becomes significantly less than the wall thickness of the product at the corresponding portion when the dies are closed, and the temperature of said pad is maintained substantially lower than the softening temperature of said thermoplastic resin.

2. The method according to claim 1, wherein said pad is made of a material having thermal conductivity which is significantly lower than that of said dies.

3. The method according to claim 2, wherein said material having low conductivity is a fluorine resin.

4. The method according to claim 1, wherein a horizontal step portion having a contour which is similar to but not greater than the contour of the aperture edge of said female die is formed around said aperture edge, said fibre board material is cut in coincidence with contour of said step portion and fit in said step portion, thereby preventing the peripheral portion of the material from being pressed between the horizontal surfaces of said dies when the dies are closed.

5. The method according to claim 4, wherein the width of said horizontal step portion is substantially inversely proportional to the horizontal distance to the corresponding aperture edge from the extreme bottom of said female die.

* * * * *